United States Patent [19]

Smits

[11] Patent Number: 4,565,724

[45] Date of Patent: Jan. 21, 1986

[54] ROOFING-MATERIAL

[75] Inventor: Philippus R. J. Smits, Basel, Switzerland

[73] Assignee: CBL Consolidated Ltd. BS, Switzerland

[21] Appl. No.: 642,119

[22] Filed: Aug. 20, 1984

[30] Foreign Application Priority Data

Aug. 24, 1983 [NL] Netherlands ..... 8302958

[51] Int. Cl.[4] ..... B32B 3/24

[52] U.S. Cl. ..... 428/138; 428/194; 428/214; 428/489; 428/285; 156/337

[58] Field of Search ..... 428/137, 194, 214, 489, 428/291, 251, 261, 282, 285, 138; 156/337

[56] References Cited

U.S. PATENT DOCUMENTS 4,368,228 1/1983 Gorgati ..... 428/489 X 4,421,807 12/1983 Clausing et al. ..... 428/194 X

*Primary Examiner*—Alexander S. Thomas

*Attorney, Agent, or Firm*—Pahl, Lorusso & Loud

[57] ABSTRACT

The invention relates to a roofing-material provided with perforations and comprising a bituminized carrier with a non-sticking lower surface and destined for being applied on a substratum and for being covered by an upper layer, which may contain a carrier which is bituminized with modified bitumen, and which may be applied by means of a torch.

According to the invention the carrier of the roofing-material is bituminized with modified bitumen, and the perforations are so large that the upper layer can be directly applied on the roofing-material by means of a torch and can be adhered to the substratum via the perforations.

9 Claims, 2 Drawing Figures

ROOFING-MATERIAL

The invention relates to a roofing-material provided with perforations and comprising a bituminized carrier with a non-sticking lower surface and destined for being applied on a substratum and for being covered by an upper layer, which may contain a carrier which is bituminized with modified bitumen, and which may be applied by means of a torch.

With a known roofing an under-layer is laid on a substratum consisting for instance of a covered plastic foam, such as polystyrene foam or polyurethane foam, or of an old existing roofing. This under-layer consists of the roofing-material of the type described hereinabove and is composed of glass fibre mat, which is bituminized with blown bitumen and which has a non-sticking surface on one side and is provided with small perforations with a diameter of about 1.5 cm, which together take up about 4% of the total surface.

The under-layer is fixed to the substratum at the location of the roof-edges over a width of about 2 meters with an adhesive layer of blown bitumen, which has first been liquefied in a bitumen-heater and which is applied in a sine-shaped generally by means of a can. The roofing-material which forms the under-layer is not fixed to the remaining part of the substratum.

Subsequently an extra coat of blown bitumen is applied on the roofing-material forming this under-layer, which bitumen has also been liquefied beforehand in a bitumen-heater, whereby the liquid bitumen locally adheres to the substratum through the perforations in the under-layer.

Thereupon an upper layer, for example consisting of bituminized polyester mat, wherein the bitumen is modified with atactic polyproplyene, is applied by means of a propane torch or burner or the like on the whole surface of the under-layer with staggered cross-overlappings, whereafter the overlappings are checked and are after-treated, if necessary. The coating of modified bitumen at the lower side of this mat may be thicker than the coating of modified bitumen on the upper side of the mat.

This known roofing in itself has been very satisfactory, but nevertheless it still has several disadvantages.

Although the upper layer is applied by means of the torching-method, so that for this purpose the use of the bitumen-heater, which is in fact very objectionable, is not necessary, this bitumen-heater is yet required with the known roofing for applying the above-mentioned adhesive layer for fixing the under-layer at the location of the roof-edges, as well as for the application of the extra coat, so that the advantage of the use of the torching-method for applying the upper layer is lost again for the greater part.

Further the adherence through the perforations in the under-layer amounts only to about 4%, so that the above-mentioned additional fixation of the under-layer along the roof-edges is necessary.

Furthermore the roofer has, especially in summer, a lot of hindrance of the extra coat, which remains sticky during a long time, so that walking on it is rather difficult.

An important disadvantage connected with the known roofing-material consists in that the extra coat, which has to be applied in liquid condition cannot consist of modified bitumen, as this would make too high demands upon the bitumen-heater.

Therefore this extra coat consists of a blown bitumen, while the roofing-material forming the perforated under-layer is made with the application of blown bitumen as well. Since modified bitumen has much better characteristics than blown bitumen, it is of course unfavourable for the quality of the complete roofing when the same can only be partially made of modified bitumen.

It is an object of the present invention to further develop the roofing-material of the type mentioned hereinbefore to such extent that the objections mentioned above will be removed in an efficient manner and that it will be possible to use modified bitumen for the complete roofing.

For this purpose the roofing-material according to the invention is characterized in that the carrier of the roofing-material is bituminized with modified bitumen, and the perforations are so large that the upper layer can be directly applied on the roofing-material by means of a torch and can be adhered to the substratum via the perforations.

According to the invention the perforations in the under-layer formed from the roofing-material have such dimensions, that the upper layer can be applied by means of a torch and can yet locally be adhered to the substratum via these perforations without the application of an extra coat. With the roofing-material according to the invention it is no longer necessary to fix this material on the substratum at the location of the roof-edges, as the adherence between the upper layer and the substratum via the larger perforations is sufficiently strong.

Because the perforations in the under-layer formed from the roofing-material according to the invention are filled with modified bitumen, it will be remunerative to also use modified bitumen when manufacturing this roofing-material. In this way it is achieved that exclusively modified bitumen is used for the complete roofing.

As both the adhesive layer of blown bitumen between the under-layer and the substratum at the location of the roof-edges and the extra coat of blown bitumen have become superfluous, it is no longer necessary to use a bitumenheater, and the whole roofing can be applied by means of the torching-method.

Preferably with the roofing-material according to the invention forming the under-layer the coating of modified bitumen lying above its carrier is thicker than the coating of modified bitumen lying underneath its carrier.

In this way a large quantity of melted bitumen is obtained during the application of the torch, so that a good adherence with the upper layer, as well as, via the perforations, with the substratum, is accomplished, whilst further a buffer is formed against the heat of the propane torch. In this manner it is prevented that the parts between the perforations of the roofing-material, which form the under-layer, would be heated to such an extent that an unintended adherence to the substratum would take place.

With this measure, in combination with the application of the non-sticking surface at the lower side of the under-layer formed from the roofing-material according to the invention, an adherence to the substratum outside of the perforations is avoided, so that no formation of blisters between the under-layer and the substratum can occur.

The perforations in the roofing-material according to the invention may have a smallest inner dimension of 50–110 mm and preferably of about 70 mm.

In this case the degree of perforation of the roofing-material according to the invention may be 8–14% and preferably about 11%.

Advantageously the roofing-material according to the invention comprises bituminized perforated glass fibre mat, wherein the bitumen is modified with atactic polypropylene or a styrene-butadiene-styrene co-polymer.

Further the roofing-material according to the invention may have the form of a strip, which has a thinned selvage at one longitudinal side.

In this way it is prevented that the overlappings of adjacent strips would become too thick.

The invention will be elucidated hereafter with reference to the drawing.

Figures 1, 2:
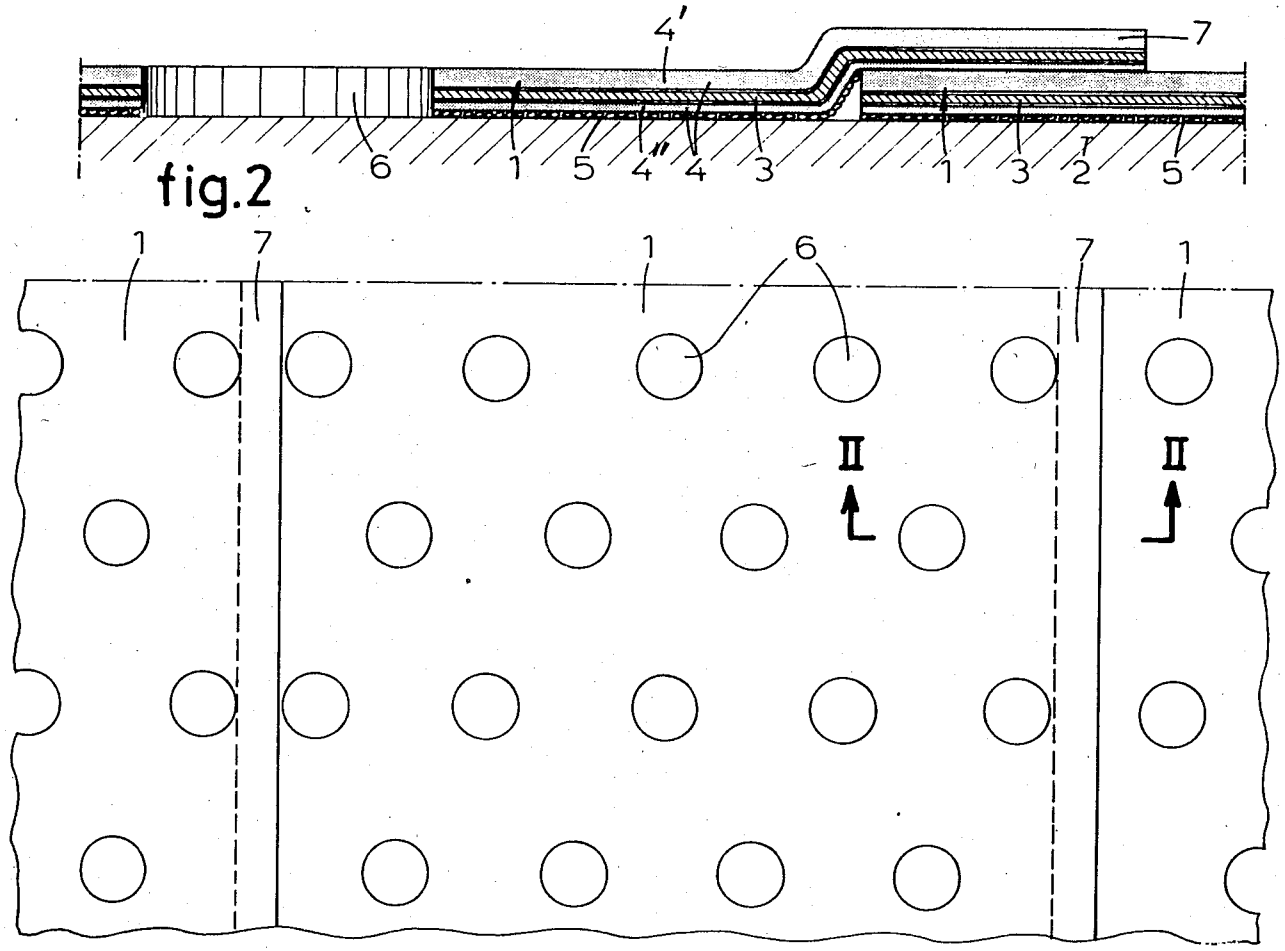
FIG. 1 is a partial top view of several adjacent strips of the roofing-material according to the invention.
FIG. 2 is a section along the plane II—II in FIG. 1 on a larger scale.

The drawing shows a number of strips 1 formed from the roofing-material according to the invention, which are used as the under-layer of a roofing. These strips 1 may be delivered in the form of rolls and are applied on a substratum 2, which for instance consists of covered plastic foam like polystyrene foam, polyurethane foam or the like, or of an old roofing.

The strips 1 each consist of a carrier 3 bituminized with modified bitumen 4, and provided at the lower side with a coat of fine gravel 5 applied during the manufacture of the strips. As an alternative for the gravel 5 another type of non-sticking material, such as a plastic foil may be used.

The strips 1 of roofing-material according to the invention, which form the under-layer, are provided with perforations 6, having a diameter of 50–110 mm and preferably of about 70 mm, while the degree of perforation is 8–14% and preferably about 11%.

With advantage the strips 1 may comprise a bituminized perforated glass fibre mat, wherein the bitumen is modified with an atactic polypropylene or a styrene-butadiene-styrene co-polymer.

With the strips 1 of the roofing-material according to the invention the coating of modified bitumen 4' lying above the carrier 3 is thicker than the coating of modified bitumen 4'' lying underneath the carrier.

At one longitudinal side each strip 1 of the roofing-material according to the invention has a thinned selvage 7 without gravel.

For constructing the complete roofing first a number of strips 1 are laid on a substratum 2 which strips are formed from the roofing-material according to the invention and are serving as an under-layer. As appears from FIGS. 1 and 2, the selvage 7 always overlaps the adjacent strip 1.

Hereafter the strips of the upper layer (not shown) each consisting of a carrier bituminized with modified bitumen, for instance of bituminized polyester mat, wherein the bitumen is modified with e.g. an atactic polypropylene, are applied by means of the torch on the roofing-material according to the invention which forms the under-layer. The coating of modified bitumen underneath the mat is thicker than the coating of modified bitumen above the mat. The strips of the upper layer locally adhere to the substratum via the perforations 6 in the roofing-material which forms the under-layer.

The roofing-material according to the invention has important advantages.

In the first place the adherence to the substratum is at least three times as strong as with the known roofing-material, so that no additional adherence along the roof-edges is necessary anymore.

Further, due to the larger dimensions of the perforations in the roofing-material according to the invention the upper layer can be adhered to the substratum by means of the torching-method, so that the use of a bitumen-heater is no longer necessary and the application of the complete roofing can be realized very quickly.

Since the extra coat between the under-layer and the upper layer has become superfluous, the roofing may be applied without any objection even if the weather is very warm.

A further important advantage obtained according to the invention consists in that for the construction of the roofing only modified bitumen and no blown bitumen is used.

The invention is not restricted to the embodiment shown in the drawing by way of example which may be varied in several ways within the scope of the appended claims.

I claim:

1. Roofing-material provided with perforations and comprising a bituminized carrier underlayer with a non-sticking lower surface and destined for being applied on a substratum and for being covered by an upper layer, which contains a carrier which is bituminized with modified bitumen, and which may be applied by means of torch, wherein the carrier of the roofing material is bituminized with modified bitumen, has a coating lying above and below the carrier, and the perforations extending therethrough having a smallest inner dimension of 50-110 mm, and preferably of about 70 mm, are so large that the upper layer can be directly applied on the roofing material by means of a torch thereby simultaneously adhering the upper layer and the bituminized carrier underlayer to the substratum, and the upper layer to the bituminized carrier underlayer itself, via the perforations only.

2. Roofing-material according to claim 1, wherein the coating of modified bitumen lying above its carrier is thicker than the coating of modified bitumen lying underneath its carrier.

3. Roofing-material according to claim 1 wherein the degree of perforation relative to the surface area of the bituminized carrier underlayer is 8–14% and preferably about 11%.

4. Roofing-material according to claim 1, wherein the same comprises bituminized perforated glass fibre mat, wherein the bitumen is modified with atactic polypropylene or styrene-butadiene-styrene co-polymer.

5. Roofing-material according to claim 1, wherein the same has the form of a strip, which has a thinned selvage at one longitudinal side.

6. Roofing-material provided with perforations and comprising a bituminized carrier with a non-sticking lower surface, said carrier being provided with bituminized perforated glass fibre mat, wherein the bitumen is modified with atactic polypropylene or styrene-butadiene-styrene copolymer, the coating of modified bitumen lying above the glass fibre mat being thicker than the coating of modified bitumen lying underneath the glass fibre mat, the roofing-material having the form of a strip, which has a thinned selvage at a longitudinal side; while the perforations have a smallest inner dimension of 50–110 mm, and preferably of about 70 mm and the degree of perforation relative to the surface area of the bituminized carrier underlayer is 8–14% and preferably about 11%, so that an upper layer can be directly applied on a substratum by means of a torch thereby simultaneously adhering the upper layer and the bituminized carrier to the substratum and the upper layer to the bituminized carrier itself, solely via the perforations.

7. A method for applying roofing-material on a substratum which comprises the steps of:

laying onto the substratum a plurality of adjacent roofing-material strips having a bituminized carrier underlayer of modified bitumen havaing a plurality of large perforations, of a smallest inner dimension of 50–110 mm and a degree of perforation relative to the surface area of the bituminized carrier underlayer of 8–14%, extending therethrough;

covering the plurality of roofing-material strips with a waterproof upper layer containing a carrier bituminized with modified bitumen;

heating the modified bitumen upper layer so that melted modified bitumen communicates with the substratum through the large perforations; and solidifying the melted modified bitumen thereby adhering simultaneously the bituminized carrier underlayer and waterproof upper layer to the substratum, and the bituminized carrier underlayer to the waterproof upper-layer itself.

8. The method of claim 7, wherein the step of laying a plurality of adjacent ships of roofing material further comprises overlapping a longitudinal end of a roofing-material strip with a longitudinal end of an adjacent roofing-material strip.

9. The method of claim 7, wherein the step of heating the modified bitumen upper layer comprises applying a torch to the modified bitumen upper layer.

* * * * *